US006899604B2

(12) United States Patent
Togawa et al.

(10) Patent No.: US 6,899,604 B2
(45) Date of Patent: May 31, 2005

(54) DRESSING APPARATUS AND POLISHING APPARATUS

(75) Inventors: Tetsuji Togawa, Tokyo (JP); Ikutaro Noji, Tokyo (JP); Shunichiro Kojima, Tokyo (JP); Nobuyuki Takada, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/204,600

(22) PCT Filed: Jan. 17, 2002

(86) PCT No.: PCT/JP02/00274

§ 371 (c)(1),
(2), (4) Date: Jan. 24, 2003

(87) PCT Pub. No.: WO02/057051

PCT Pub. Date: Jul. 25, 2002

(65) Prior Publication Data

US 2003/0148707 A1 Aug. 7, 2003

(30) Foreign Application Priority Data

Jan. 19, 2001 (JP) ..... 2001-11730

(51) Int. Cl.[7] ..... B24B 7/00
(52) U.S. Cl. ..... 451/72; 451/443; 451/444
(58) Field of Search ..... 451/56, 72, 443, 451/444, 285, 286, 287, 288, 289

(56) References Cited

U.S. PATENT DOCUMENTS

| | | | | |
|---|---|---|---|---|
| 5,885,137 | A | | 3/1999 | Ploessl |
| 6,200,199 | B1 | * | 3/2001 | Gurusamy et al. ..... 451/56 |
| 6,217,429 | B1 | * | 4/2001 | Hoey ..... 451/443 |
| 6,263,605 | B1 | * | 7/2001 | Vanell ..... 451/443 |
| 6,572,446 | B1 | | 6/2003 | Osterheld et al. |

FOREIGN PATENT DOCUMENTS

| | | |
|---|---|---|
| JP | 59-81056 | 5/1984 |
| JP | 11-58217 | 3/1999 |
| JP | 2000-202758 | 7/2000 |
| JP | 2000-343406 | 12/2000 |
| JP | 2001-246550 | 9/2001 |
| WO | 99/50022 | 10/1999 |

* cited by examiner

*Primary Examiner*—Dung Van Nguyen
(74) *Attorney, Agent, or Firm*—Wenderoth, Lind & Ponack, L.L.P.

(57) ABSTRACT

A dressing apparatus dresses a polishing surface of a polishing table used for polishing a workpiece such as a semiconductor wafer in a polishing apparatus. The dressing apparatus comprises a dresser body (31) connected to a dresser drive shaft (23) which is vertically movable, a dresser plate (32) which is vertically movable with respect to the dresser body (31), and a dressing member (22) held by the dresser plate (32) for dressing the polishing surface (1*a*).

14 Claims, 8 Drawing Sheets

DRESSING APPARATUS AND POLISHING APPARATUS

TECHNICAL FIELD

The present invention relates to a dressing apparatus for dressing a polishing surface of a polishing table used for polishing a workpiece in a polishing apparatus, and a polishing apparatus having such dressing apparatus for polishing a workpiece such as a semiconductor wafer to a flat mirror finish.

BACKGROUND ART

Recently, semiconductor devices have become more integrated, and the structure of semiconductor elements has become more complicated. In addition, the number of layers in multilayer interconnections used for a logical system has been increased. Therefore, irregularities on the surface of the semiconductor device are increased, so that the step height on the surface of the semiconductor device becomes larger.

When the irregularities of the surface of the semiconductor device are increased, the following problems arise. The thickness of a film formed in a portion having a step is relatively small. An open circuit is caused by disconnection of interconnections, or a short circuit is caused by insufficient insulation between the layers. As a result, good products cannot be obtained, and the yield is reduced. Further, even if a semiconductor device initially works normally, reliability of the semiconductor device is lowered after a long-term use. At the time of exposure in a lithography process, if the irradiation surface has irregularities, then a lens unit in an exposure system is locally unfocused. Therefore, if the irregularities of the surface of the semiconductor device are increased, then it is difficult to form a fine pattern on the semiconductor device.

Thus, in the manufacturing process of a semiconductor device, it is increasingly important to planarize the surface of the semiconductor device. The most important one of the planarizing technologies is chemical mechanical polishing (CMP). In the chemical mechanical polishing using a polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface so that the substrate is polished.

Conventionally, such a polishing apparatus has a polishing table having a polishing pad (or fixed abrasive) attached to the upper surface thereof, and a top ring for holding a substrate (object to be polished) such as a semiconductor wafer. A polishing liquid containing abrasive particles is supplied from a nozzle onto the polishing pad and retained on the polishing pad. The polishing pad (or fixed abrasive) on the polishing table constitutes a polishing surface. During operation, the top ring exerts a certain pressure to press the substrate against the polishing surface of the polishing table, and the surface of the substrate is therefore polished to a flat mirror finish while the top ring and the polishing table are rotating. The polishing liquid comprises abrasive particles such as silica particles, and chemical solution such as alkaline solution in which the abrasive particles are suspended. Thus, the substrate is chemically and mechanically polished by a combination of a mechanical polishing action of abrasive particles in the polishing liquid and a chemical polishing action of chemical solution in the polishing liquid.

When the polishing process is finished, the polishing capability of the polishing pad is gradually deteriorated due to a deposition of the abrasive particles and ground-off particles removed from the substrate, and due to changes in the characteristics of the surface of the polishing pad. Therefore, if the same polishing pad is used to repeatedly polish the substrates, the polishing rate of the polishing apparatus is lowered, and the polished substrates tend to suffer polishing irregularities. Therefore, it has been customary to condition the polishing pad according to a process called "dressing" for regenerating the surface of the polishing pad.

In order to dress the surface of the polishing pad which has been deteriorated by polishing, a dressing apparatus having a dressing member is provided adjacent to the polishing table. In the dressing operation by the dressing apparatus, the dressing member fixed to a dresser head is pressed against the polishing pad (polishing surface) of the polishing table, and the dresser head and the polishing table are rotated relatively to each other for thereby bringing the dressing member in sliding contact with the polishing pad (polishing surface). Thus, the polishing liquid containing abrasive particles and the ground-off particles attached to the polishing surface are removed, and planarization and regeneration of the polishing surface are conducted. The dressing member generally comprises a dressing surface on which diamond particles are electrodeposited, and the dressing surface is brought into contact with the polishing surface.

In dressing of the polishing surface of the polishing table by the above dressing apparatus, there are two dressing methods. In one method, dressing of the polishing surface is conducted simultaneously with polishing of the substrate. In the other method, dressing of the polishing surface is conducted between polishing of the substrates, i.e. before or after polishing of the substrate. In both of the dressing methods, because the polishing surface is slightly scraped off by a dressing operation, if a dressing load applied to the polishing surface by the dressing member is large, then the service life of the polishing pad (or fixed abrasive) is shortened, resulting in an increase in cost. Therefore, there has been a demand for reducing the dressing load to minimize an amount of material to be removed from the polishing surface in the dressing operation.

DISCLOSURE OF INVENTION

The present invention has been made in view of the above, and it is therefore an object of the present invention is to provide a dressing apparatus which can reduce a dressing load applied to a polishing surface of a polishing table in a dressing operation, and a polishing apparatus having such dressing apparatus.

According to a first aspect of the present invention, there is provided a dressing apparatus for dressing a polishing surface of a polishing table for polishing a surface of a workpiece; the dressing apparatus comprises a dresser body connected to a dresser drive shaft which is vertically movable, a dresser plate which is vertically movable with respect to the dresser body, and a dressing member held by the dresser plate for dressing the polishing surface.

According to the present invention, because a dresser plate for holding a dressing member is vertically movable with respect to a dresser body, after a dresser drive shaft is lowered to bring the dressing member into contact with a polishing surface on a polishing table, the dresser body is further lowered to allow the dresser plate to be released from the dresser body, and hence only the weight of the dresser plate including the dressing member is applied to the polishing surface. Therefore, a dressing load can be a light load.

In a preferred aspect of the present invention, the dressing apparatus further comprises a gimbal mechanism provided between the dresser body and the dresser plate such that the dresser plate is tiltable so as to follow an inclination of the polishing surface and is vertically movable with respect to the dresser body. That is, the dresser plate including the dressing member is freely tiltable so as to follow undulations of the polishing surface with the gimbal mechanism.

In a preferred aspect of the present invention, the dressing apparatus further comprises a stopper provided on the dresser plate for preventing the dresser plate from falling from the dresser body by allowing the stopper to engage the dresser body when the dresser drive shaft is lifted. That is, the dresser plate is vertically freely movable with respect to the dresser body, and when the dresser body is lifted, the stopper engages the dresser body, and hence the dresser plate is prevented from falling from the dresser body.

In a preferred aspect of the present invention, a dressing load is obtained by the weight of the dresser plate including the dressing member, and the dressing apparatus further comprises a load adjusting mechanism for applying a desired load to the dresser plate by fixing the desired number of weights to the dresser plate. That is, in the case where a dressing load is insufficient only by the weight of the dresser plate including the dressing member, additional weights are fixed to the dresser plate to increase the dressing load.

In a preferred aspect of the present invention, the dressing apparatus further comprises a hermetically sealed space defined by the dresser body, the dresser plate and a resilient membrane, and the dresser body and the dresser plate are connected by the resilient membrane. Further, a fluid having a positive pressure or a negative pressure is supplied to the hermetically sealed space, and a dressing load is adjusted by controlling the positive pressure or the negative pressure.

In a preferred aspect of the present invention, the dressing apparatus further comprises a hermetically sealed space provided between the dresser body and the dresser plate or a member fixed to the dresser plate, and at least a part of the hermetically sealed space is formed by a resilient membrane. Further, a fluid having a positive pressure or a negative pressure is supplied to the hermetically sealed space to generate an upward force or a downward force applied to the dresser plate.

According to the present invention, when an upward force applied to the dresser plate is generated, a dressing load is obtained by subtracting the upward force obtained by supplying the positive pressure or the negative pressure to the hermetically sealed space from a weight of the dresser plate including the dressing member. Therefore, a light dressing load which is smaller than the weight of the dresser plate can be achieved, and it is possible to control the dressing load so as to be close to no load.

In a preferred aspect of the present invention, when the dresser plate is vertically moved with respect to the dresser body, pressure-bearing areas of upper and lower surfaces in the hermetically sealed space are not varied.

According to the present invention, the fluid supplied to the hermetically sealed space comprises a compressible fluid such as air or nitrogen. Further, the resient membrane for defining the hermetically sealed space is made of a relatively soft material having a good flexibility, such as EPDM (ethylene propylene diene monomer), polyurethane rubber, or silicone rubber.

According to a second aspect of the present invention, there is provided a polishing apparatus for polishing a surface of a workpiece, the polishing apparatus comprising a polishing table having a polishing surface, a holder for holding the workpiece, a pressing device for pressing the workpiece held by the holder against the polishing surface, and a dressing apparatus having the above structure.

BEST MODE FOR CARRYING OUT THE INVENTION

A dressing apparatus and a polishing apparatus having such dressing apparatus according to embodiments of the present invention will be described below with reference to FIGS. 1 through 8.

Figure 1:
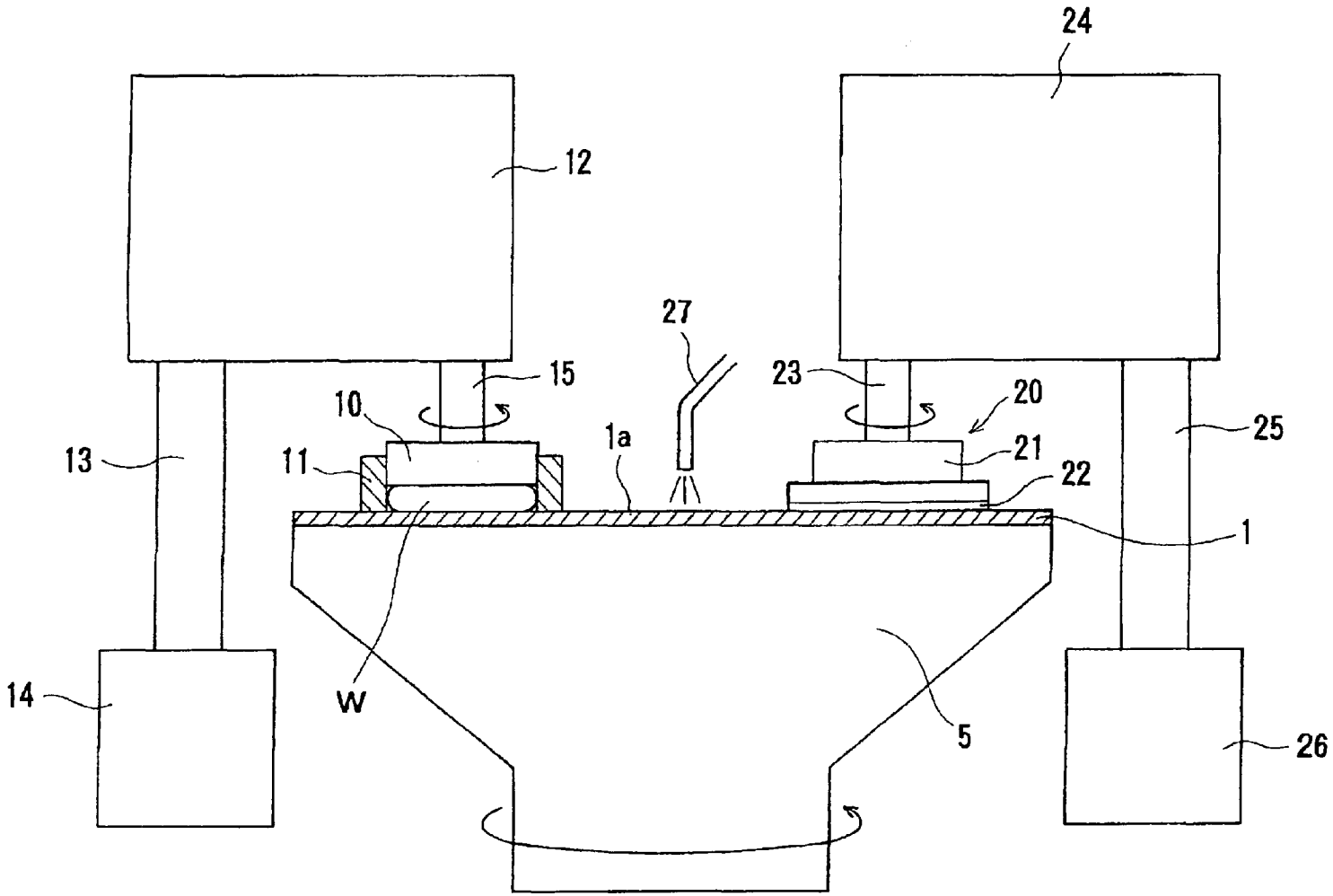
FIG. 1 is a front elevational view of a polishing apparatus having a dressing apparatus according to the present invention.

FIG. 1 is a front elevational view of a polishing apparatus having a dressing apparatus according to the present invention. As shown in FIG. 1, the polishing apparatus comprises a polishing table 5 having a polishing pad (or fixed abrasive) 1 attached to the upper surface thereof, a top ring 10 for holding a semiconductor wafer W as a substrate and pressing the semiconductor wafer W against a polishing surface 1*a* comprising an upper surface of the polishing pad 1, and a dressing apparatus 20 for dressing an upper surface (polishing surface 1*a*) of the polishing pad (or fixed abrasive). A slurry-like polishing liquid containing abrasive particles is supplied from a polishing liquid supply nozzle 27 onto the polishing surface 1*a* of the polishing pad 1.

A guide ring 11 is provided on an outer circumferential portion of the top ring 10 to prevent the semiconductor wafer W from being disengaged from the top ring 10. The top ring 10 is supported from a top ring arm 12 by a top ring drive shaft 15. The top ring arm 12 is supported by a support shaft 13 which can be angularly positioned, and the top ring 10 can access the polishing table 5 and a pusher (not shown) by rotating the support shaft 13 with a motor 14. The pusher serves as a transfer device for transferring the semiconductor wafer between the top ring 10 and the pusher.

Further, the dressing apparatus 20 comprises a dresser head 21 and a dressing member 22 fixed to the dresser head 21. The dresser head 21 is supported from a dresser arm 24 by a dresser drive shaft 23. The dresser arm 24 is supported by an angularly positionable support shaft 25, and the dresser head 21 can access the polishing table 5 and a standby position by rotating the support shaft 25 with a motor 26.

In the case where the polishing surface 1*a* comprises a polishing pad, the polishing pad comprises a disk-like member which is composed of polyurethane foam, or nonwoven fabric composed of fibers bound with urethane resin. On the other hand, in the case where the polishing surface 1*a* comprises a fixed abrasive, the fixed abrasive is composed of abrasive particles of $CeO_2$ or $SiO_2$ or $Al_2O_3$ which are fixed by a binder comprising thermosetting resin such as epoxy resin or phenolic resin, or thermoplastic resin such as methylmethacrylate butadiene styrene or acrylonitrile butadiene styrene. The abrasive particles have an average particle diameter of 0.5 $\mu$m or less.

In the polishing apparatus having the above structure, the semiconductor wafer W is held by the lower surface of the top ring 10 and pressed against the polishing pad (or fixed abrasive) 1 on the polishing table 5 by the top ring 10, while the polishing table 5 and the top ring 10 are rotated. Therefore, the semiconductor wafer W is polished by a relative sliding motion between the polishing pad 1 and the semiconductor wafer W. At this time, a polishing liquid is supplied onto the polishing surface 1*a* of the polishing pad 1 from the polishing liquid supply nozzle 27.

The polishing liquid comprises abrasive particles such as silica ($SiO_2$) particles, and chemical solution such as alkaline solution in which the abrasive particles are suspended. Thus, the semiconductor wafer W is chemically and mechanically polished to a flat mirror finish by a combination of a mechanical polishing action of abrasive particles in the polishing liquid and a chemical polishing action of chemical solution in the polishing liquid.

On the other hand, when the abrasive particles in the polishing liquid and ground-off particles removed from the semiconductor wafer are deposited on the surface of the polishing pad (or fixed abrasive) 1 constituting the polishing surface 1*a* to cause clogging of the polishing surface, stable polishing performance cannot be obtained. Therefore, during polishing operation of the semiconductor wafer or between polishing operations of the semiconductor wafers, a dressing liquid such as pure water is supplied onto the polishing surface 1*a* of the polishing pad 1 on the rotating polishing table 5 from a dressing liquid supply device (not shown), and while the dresser head 21 of the dressing apparatus 20 is rotated, the dressing member 22 is pressed against the polishing surface 1*a*. Thus, the polishing surface 1*a* is scraped slightly in the order of $\mu$m to remove the abrasive particles in the polishing liquid and the ground-off particles, thus regenerating the polishing surface 1*a* and keeping the polishing surface 1*a* in a constant condition at all times.

The structural details of the dressing apparatus shown in FIG. 1 will be described below with reference to FIGS. 2 through 8.

Figure 2:
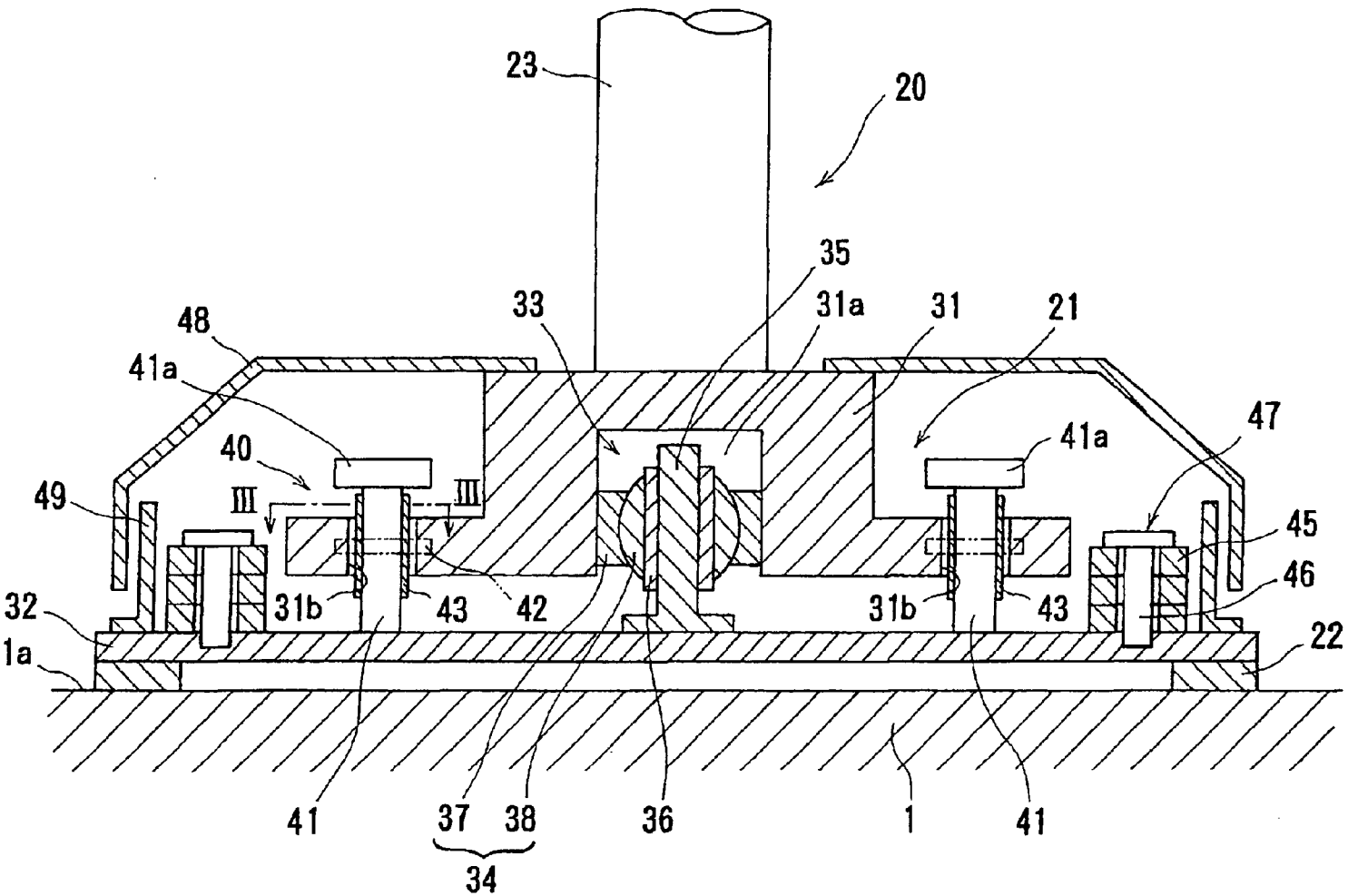
FIG. 2 is a cross-sectional view of a dressing apparatus according to a first embodiment of the present invention.

FIG. 2 shows in cross section a dressing apparatus according to a first embodiment of the present invention. As shown in FIG. 2, the dressing apparatus 20 comprises the dresser head 21 connected to the dresser drive shaft 23, and the dressing member 22 fixed to the dresser head 21. The dresser head 21 comprises a dresser body 31 coupled to the dresser drive shaft 23 and a disk-shaped dresser plate 32 which holds the dressing member 22. The dresser head 21 further comprises a gimbal mechanism 33, interconnecting the dresser body 31 and the dresser plate 32 such that the dresser plate 32 is tiltable with respect to the dresser body 31, and a rotation transmitting mechanism 40 for transmitting the rotation of the dresser drive shaft 23 to the dresser plate 32. The dresser body 31 and the dresser drive shaft 23 may be connected to each other through another member without direct coupling.

The gimbal mechanism 33 is disposed in a downwardly open recess 31*a* formed centrally in a lower portion of the dresser body 31. The gimbal mechanism 33 comprises a spherical slide bearing 34, a centering shaft 35 fixed to the dresser plate 32, and a linear bearing 36 inserted between the spherical bearing 34 and the centering shaft 35. The spherical bearing 34 comprises a fixed member 37, fixed to the dresser body 31 and having a hemispherical concave surface, and a substantially spherical movable member 38 slidably fitted in the hemispherical concave surface of the fixed member 37. The linear bearing 36 is inserted and fixedly positioned in the substantially spherical movable member 38. The centering shaft 35 fixed to the dresser plate 32 is fitted in the linear bearing 36.

The centering shaft 35 is vertically movable with respect to the linear bearing 36, and the linear bearing 36 and the movable member 38 are rotatable with respect to the fixed member 37. Therefore, the spherical bearing 34 allows the dresser plate 32 to be tilted and the linear bearing 36 allows the dresser plate 32 to be moved vertically without causing the dresser plate 32 to be brought out of coaxial alignment with the dresser body 31.

The rotation transmitting mechanism 40 has a plurality of torque transmitting pins 41 mounted on the dresser plate 32 at angularly spaced intervals along a certain circumferential pattern and fixed to the dresser plate 32. The torque transmitting pins 41 extend vertically through respective through-holes 31*b* formed in an outer circumferential flange of the dresser body 31.

Figure 3:
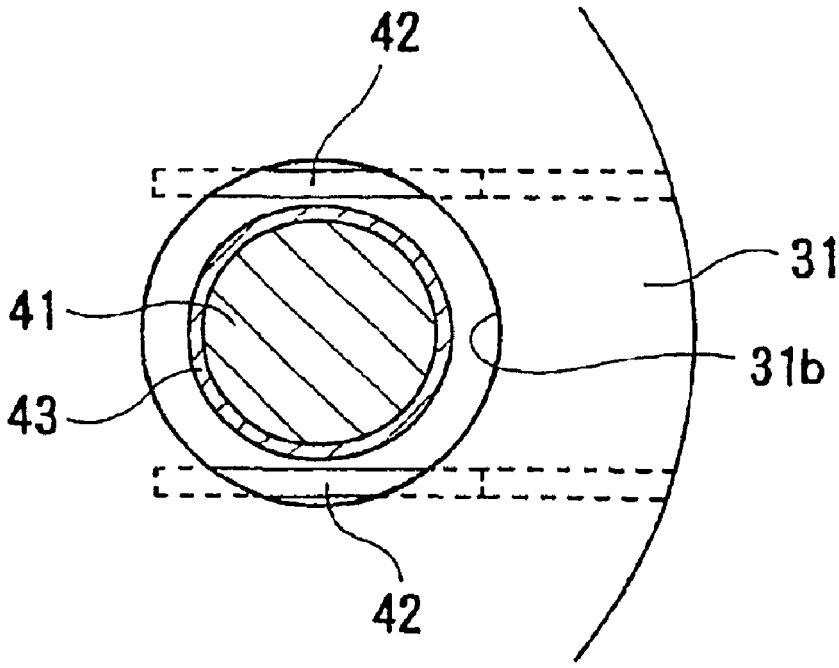
FIG. 3 is an enlarged cross-sectional view taken along line III—III of FIG. 2.

FIG. 3 shows one of the torque transmitting pins 41 in detail, the view being a cross-sectional view taken along line III—III of FIG. 2. The torque transmitting pins 41 are identical in structure to each other, and one of the torque transmitting pins 41 will be described below. As shown in FIG. 3, two spaced pins 42 are horizontally disposed in the dresser body 31, one on each side of the torque transmitting pin 41, and extend partly through the through-hole 31*b*. A damper sleeve 43 made of rubber or the like is fitted over the torque transmitting pin 41. The torque transmitting pin 41 and the pins 42 engage each other through the damper sleeve 43. When the dresser drive shaft 23 is rotated about its own axis, the dresser body 31 rotates in unison with the dresser drive shaft 23. The rotation of the dresser body 31 is transmitted to the dresser plate 32 through the engagement between the torque transmitting pin 41 and the pins 42. During dressing of the polishing surface 1*a* of the polishing table 5, the dresser plate 32 is tilted so as to follow the inclination (or undulation) of the polishing surface 1*a*. When the dresser plate 32 is tilted, since the torque transmitting pin 41 on the dresser plate 32 and the pins 42 on the dresser body 31 engage each other through point-to-point contact, the torque transmitting pin 41 and the pins 42 are held in reliable engagement while varying points of contact, thus allowing the rotational forces of the dresser drive shaft 23 to be transmitted reliably to the dresser plate 32.

The torque transmitting pins 41 have respective stoppers 41*a* which are and are mounted on their upper ends larger in size than the inner diameters of the through-holes 31*b*. When the dresser head 21 is lifted, the stoppers 41*a* engage the upper surface of the dresser body 31, thus preventing the dresser plate 32 from falling from the dresser body 31. The dresser plate 32 is combined with a plurality of load adjusting mechanisms 47 comprising weights 45 fixed to the dresser plate 32 by bolts 46. The load adjusting mechanisms 47 are disposed at angularly equally spaced intervals along a certain circumferential pattern on the dresser plate 32. The number of weights 45 of each of the load adjusting mechanisms 47 can be selected as desired.

In order to prevent a polishing liquid and a dressing liquid from entering the dresser head 21, covers 48 and 49 are mounted on the dresser body 31 and the dresser plate 32, respectively.

The dressing member 22 fixed to the dresser head 21 may be of an annular shape as shown FIG. 2 or a disk shape. Diamond particles are electrodeposited on the lower surface of the dressing member 22. The dressing member 22 may be made of ceramics such as SiC or may be made of any of various other materials.

Operation of the dressing apparatus constructed as shown in FIGS. 2 and 3 will be described below.

An air cylinder (not shown) housed in the dresser arm 24 (see FIG. 1) is actuated to lower the dresser drive shaft 23 together with the dresser head 21. At this time, the stoppers 41*a* are held in engagement with the upper surface of the dresser body 31. The dresser drive shaft 23 is lowered by a predetermined distance to bring the dressing member 22 into contact with the polishing surface 1*a* of the polishing table 5. After the dressing member 22 contacts the polishing surface 1*a* of the polishing table 5, only the dresser shaft 23 and the dresser body 31 are lowered, with the result that the stoppers 41*a* are disengaged from the dresser body 31. Further, the centering shaft 35 slides in the linear bearing 36, and the dressing apparatus 20 comes to the state shown in FIG. 2.

With the state as shown in FIG. 2, the dresser drive shaft 23 is rotated about its own axis, and the dressing member 22 is brought in sliding contact with the polishing surface 1*a*, thereby dressing the polishing surface 1*a*. At this time, the dressing load applied to the polishing surface 1*a* by the dressing member 22 is imposed only by the dresser plate 32 and the parts fixed to the dresser plate 32, and hence such dressing load is relatively small. Specifically, in the embodiment shown in FIG. 2, the dressing load is imposed by the dresser plate 32, the dressing member 22, the torque transmitting pins 41, the centering shaft 35, the load adjusting mechanisms 47, and the cover 49, i.e., the weight of the movable assembly of the dresser head 21, and hence such dressing load is a light load. The movable assembly of the dresser head 21 is movable with respect to the dresser body 31. Since the dressing load is small, an amount of material removed from the polishing surface 1*a* when the polishing surface 1*a* is dressed can be minimized. The dressing load can be adjusted to an optimum small load by adjusting the load applied by the load adjusting mechanisms 47.

Figure 4:
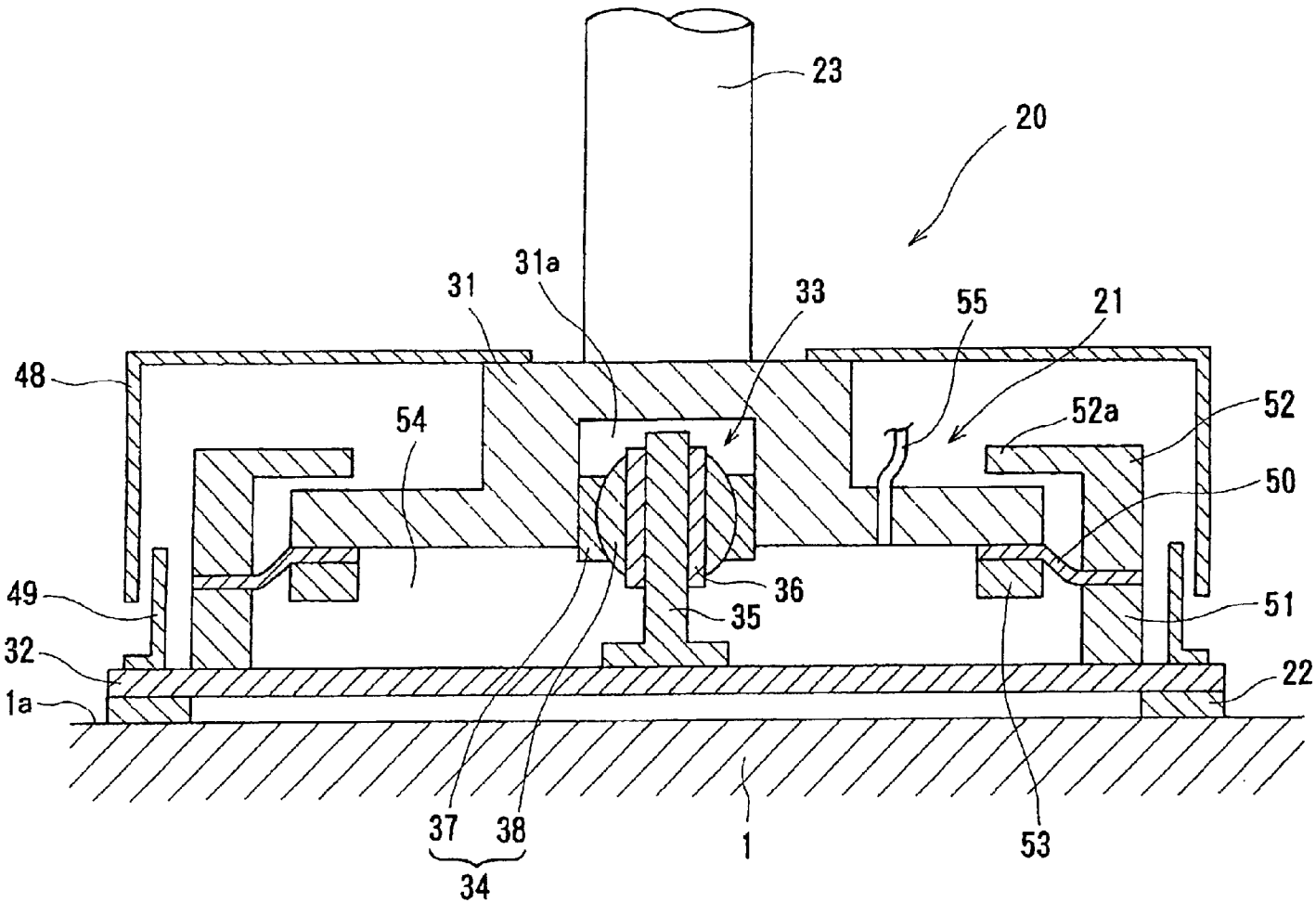
FIG. 4 is a cross-sectional view of a dressing apparatus according to a second embodiment of the present invention.

FIG. 4 shows in cross section a dressing apparatus according to a second embodiment of the present invention. As shown in FIG. 4, a dressing apparatus 20 comprises a dresser head 21 connected to a dresser drive shaft 23, and a dressing member 22 fixed to the dresser head 21. The dresser head 21 comprises a dresser body 31 coupled to the dresser drive shaft 23, a disk-shaped dresser plate 32 which holds the dressing member 22, a gimbal mechanism 33 interconnecting the dresser body 31 and the dresser plate 32 such that the dresser plate 32 is tiltable with respect to the dresser body 31, and an annular resilient membrane 50 which couples the dresser plate 32 and the dresser body 31 to each other.

The dresser plate 32 and the dresser body 31 are coupled to each other by the annular resilient membrane 50, which has an outer circumferential edge portion, sandwiched between a cylindrical projection 51 fixed to the dresser plate 32 and a substantially cylindrical stopper ring 52, and an inner circumferential edge portion sandwiched between the lower surface of the peripheral edge portion of the dresser body 31 and an annular holder ring 53. The resilient membrane 50 is made of EPDM (ethylene propylene diene monomer), polyurethane rubber, silicone rubber, or the like, and should preferably be resistant to corrosion. The dresser body 31, the resilient membrane 50, and the dresser plate 32 jointly define a hermetically sealed space 54 surrounded thereby. The hermetically sealed space 54 is connected to a fluid passage 55 which extends through a through-hole (not shown) formed in the dresser drive shaft 23 and is connected to a pressurized fluid source and/or a vacuum source via a rotary joint, a regulator, a directional control valve, etc. The pressure in the hermetically sealed space 54 can be adjusted to any desired pressure ranging from a positive pressure to a negative pressure.

The stopper ring 52 has a stopper 52*a* extending radially inwardly from the upper end thereof. When the dresser head 21 is lifted, the stopper 52*a* engages the upper surface of the dresser body 31, thus preventing the dresser plate 32 from falling from the dresser body 31. The gimbal mechanism 33, the dressing member 22, the covers 48 and 49, and other components of the dressing apparatus according to the second embodiment are identical to those of the dressing apparatus 20 according to the first embodiment.

Operation of the dressing apparatus constructed as shown in FIG. 4 will be described below. An air cylinder (not shown) housed in the dresser arm 24 (see FIG. 1) is actuated to lower the dresser drive shaft 23 together with the dresser head 21. At this time, the stopper 52*a* is held in engagement with the upper surface of the dresser body 31. The dresser drive shaft 23 is lowered by a predetermined distance to bring the dressing member 22 into contact with the polishing surface 1*a* of the polishing table 5. After the dressing member 22 contacts the polishing surface 1*a* of the polishing table 5, only the dresser shaft 23 and the dresser body 31 are lowered, with the result that the stopper 52*a* is disengaged from the dresser body 31. Further, the centering shaft 35 slides in the linear bearing 36, and the dressing apparatus 20 comes to the state shown in FIG. 4.

With the state as shown in FIG. 4, the dresser drive shaft 23 is rotated about its own axis, and the dressing member 22 is brought in sliding contact with the polishing surface 1*a*, thereby dressing the polishing surface 1*a*. At this time, the dressing load applied to the polishing surface 1*a* by the dressing member 22 is imposed only by the dresser plate 32 and the parts fixed to the dresser plate 32, and hence such dressing load is relatively small. Specifically, in the embodiment shown in FIG. 4, the dressing load is imposed by the dresser plate 32, the dressing member 22, the projection 51, the stopper ring 52, the centering shaft 35, and the cover 49, i.e., the weight of the movable assembly of the dresser head 21, and hence such dressing load is a light load. Since the dressing load is small, amount of material removed from the polishing surface 1*a* when the polishing surface 1*a* is dressed can be minimized.

If it is necessary to further reduce the dressing load, then the hermetically sealed space 54 is connected to the vacuum source and the negative pressure in the hermetically sealed space 54 is regulated by the regulator to provide a balance between the weight of the movable assembly of the dresser head 21 and the negative pressure in the hermetically sealed space 54. In this manner, a smaller dressing load is achieved. However, if the hermetically sealed space 54 is connected to a pressurized fluid source and supplied with a pressurized fluid such as compressed air from the pressurized fluid source, and the positive pressure in the hermetically sealed space 54 is regulated by the regulator, then the pressing force applied by the pressurized fluid is added to the weight of the movable assembly of the dresser head 21, thus applying a dressing load greater than the weight of the movable assembly of the dresser head 21 to the polishing surface 1*a*.

If the above process is carried out in order to apply a dressing load smaller than the weight of the movable assembly of the dresser head 21, then a dressing load equal to the weight of the movable assembly of the dresser head 21 is temporarily applied to the polishing surface 1*a* when the dressing member 22 is brought into contact with the polishing surface 1*a*. In order to avoid this drawback, the dressing apparatus 20 should preferably be operated as follows.

Before the dresser drive shaft 23 is lowered by the air cylinder (not shown) housed in the dresser arm 24 (see FIG. 1), the hermetically sealed space 54 is connected to the vacuum source to cause a maximum negative pressure to be developed in the hermetically sealed space 54. Then, the dresser drive shaft 23 is lowered by a predetermined distance to bring the dressing member 22 into contact with the polishing surface 1*a* of the polishing table 5. Thereafter, the pressure in the hermetically sealed space 54 is adjusted to a certain negative pressure to produce a desired dressing load. In this manner, the load applied when the dressing member 22 contacts the polishing surface 1*a* is prevented from being larger than necessary. The negative pressure in the hermetically sealed space 54 before the dresser drive shaft 23 is lowered may be of such a level as to achieve a desired dressing load.

Figure 5:
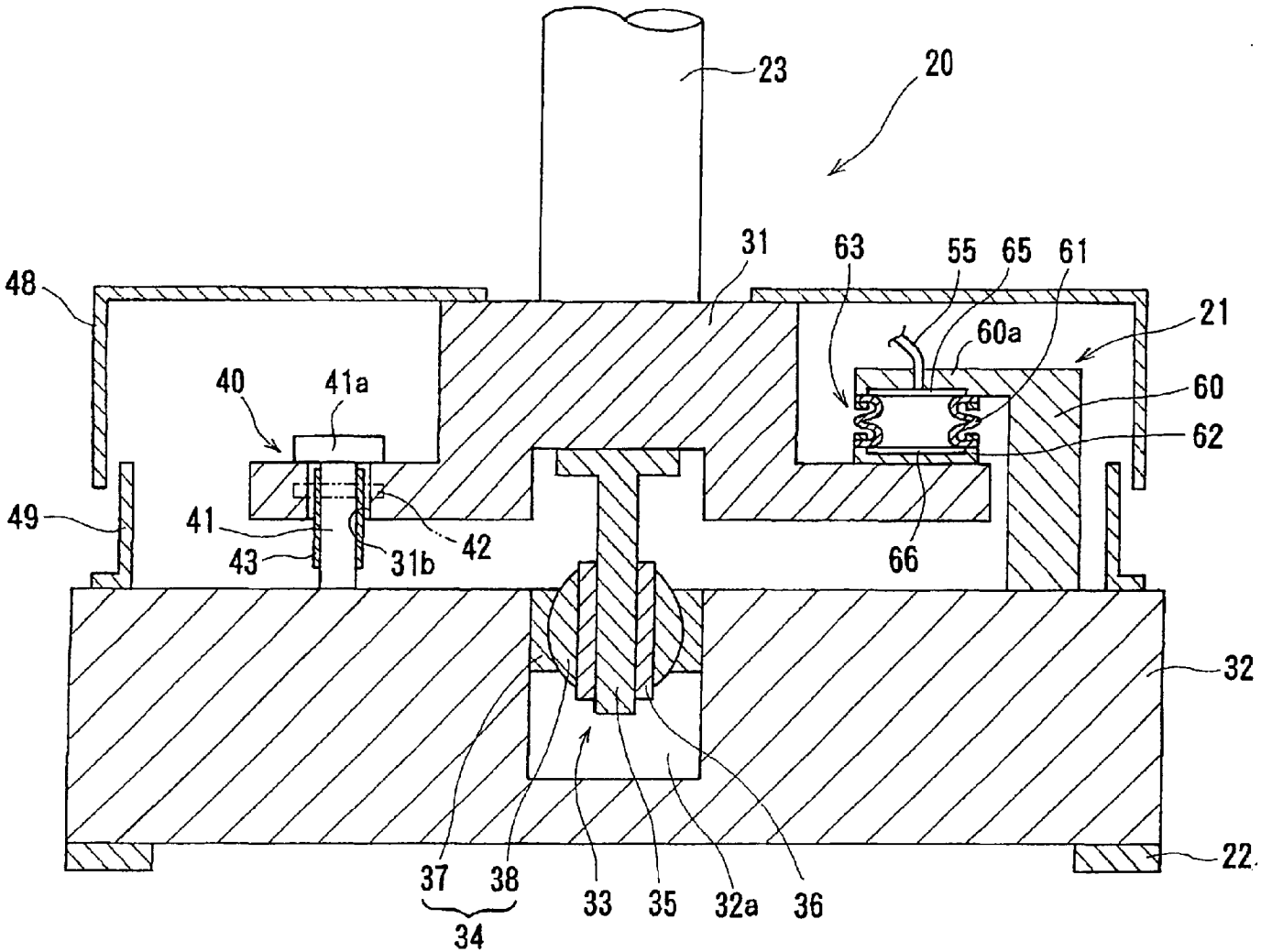
FIG. 5 is a cross-sectional view of a dressing apparatus according to a third embodiment of the present invention, the view showing the state in which the dressing apparatus is lifted from a polishing table.
Figure 6:
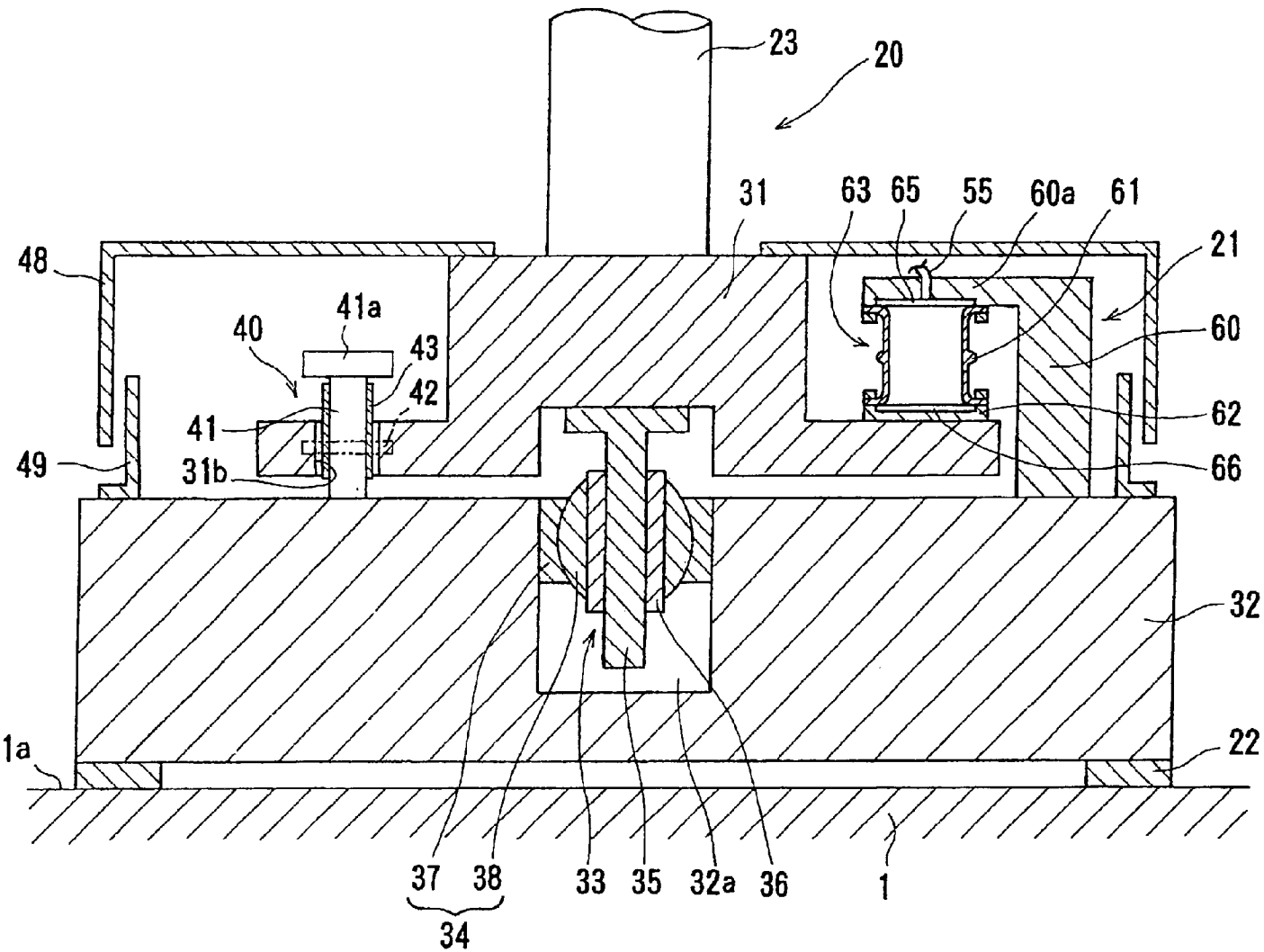
FIG. 6 is a cross-sectional view of the dressing apparatus according to the third embodiment of the present invention, the view showing the state in which the dressing apparatus is in a dressing operation of a polishing surface.

FIGS. 5 and 6 show in cross section a dressing apparatus according to a third embodiment of the present invention. FIG. 5 shows the state in which the dressing apparatus is lifted from the polishing table, and FIG. 6 shows the state in which the dressing apparatus performs dressing of the polishing surface.

As shown in FIGS. 5 and 6, a dressing apparatus 20 comprises a dresser head 21 connected to a dresser drive shaft 23, and a dressing member 22 fixed to the dresser head 21. The dresser head 21 comprises a dresser body 31 coupled to the dresser drive shaft 23, a disk-shaped dresser plate 32 which holds the dressing member 22, a gimbal mechanism 33 interconnecting the dresser body 31 and the dresser plate 32 such that the dresser plate 32 is tiltable with respect to the dresser body 31, and a rotation transmitting mechanism 40 for transmitting the rotation of the dresser drive shaft 23 to the dresser plate 32.

The gimbal mechanism 33 is disposed in an upwardly open recess 32*a* defined centrally in an upper portion of the dresser plate 32. The gimbal mechanism 33 comprises a spherical slide bearing 34, a centering shaft 35 fixed to the dresser body 31, and a linear bearing 36 inserted between the spherical bearing 34 and the centering shaft 35. The spherical bearing 34 comprises a fixed member 37 fixed to the dresser plate 32 and having a hemispherical concave surface, and a substantially spherical movable member 38 slidably fitted in the hemispherical concave surface of the fixed member 37. The linear bearing 36 is inserted and fixedly positioned in the substantially spherical movable member 38. The centering shaft 35 fixed to the dresser plate 32 is fitted in the linear bearing 36.

The centering shaft 35 is vertically movable with respect to the linear bearing 36, and the linear bearing 36 and the movable member 38 are rotatable with respect to the fixed member 37. Therefore, the spherical bearing 34 allows the dresser plate 32 to be tilted and the linear bearing 36 allows the dresser plate 32 to be moved vertically without causing the dresser plate 32 to be brought out of coaxial alignment with the dresser body 31.

The rotation transmitting mechanism 40 has a plurality of torque transmitting pins 41 mounted on the dresser plate 32 at angularly spaced intervals along a certain circumferential pattern and fixed to the dresser plate 32. The torque transmitting pins 41 extend vertically through respective through-holes 31*b* formed in an outer circumferential flange of the dresser body 31.

As with the embodiment shown in FIG. 3, two spaced pins 42 are horizontally disposed in the dresser body 31 one on each side of each of the torque transmitting pin 41 and extend partly through each of the through-hole 31*b*. A damper sleeve 43 made of rubber or the like is fitted over the torque transmitting pin 41. The torque transmitting pin 41 and the pins 42 engage each other through the damper sleeve 43. When the dresser drive shaft 23 is rotated about its own axis, the dresser body 31 rotates in unison with the dresser drive shaft 23. The rotation of the dresser body 31 is transmitted to the dresser plate 32 through the engagement between the torque transmitting pin 41 and the pins 42. During dressing of the polishing surface 1*a* of the polishing table 5, the dresser plate 32 is tilted so as to follow the inclination of the polishing surface 1*a*. When the dresser plate 32 is tilted, since the torque transmitting pin 41 on the dresser plate 32 and the pins 42 on the dresser body 31 engage each other through point-to-point contact, the torque transmitting pin 41 and the pins 42 are held in reliable engagement while varying points of contact, thus allowing the rotational forces of the dresser drive shaft 23 to be transmitted reliably to the dresser plate 32.

The torque transmitting pins 41 have respective stoppers 41*a* which are and are mounted on their upper ends larger in size than the inner diameters of the through-holes 31*b*. When the dresser head 21 is lifted, the stoppers 41*a* engage the upper surface of the dresser body 31, thus preventing the dresser plate 32 from being dislodged from the dresser body 31.

The dressing member 22, the covers 48 and 49, and other components are identical to those of the first embodiment of the present invention.

An L-shaped arm 60 is fixedly mounted on the dresser plate 32, and has an upper portion projecting upwardly of the dresser body 31. The L-shaped arm 60 has a radially inward projection 60*a* supporting a tubular bellows-shaped resilient membrane 61 on its lower surface and a disk-shaped pressure plate 62 mounted on the lower end of the tubular bellows-shaped resilient membrane 61. The resilient membrane 61 and the pressure plate 62 jointly constitutes an air bag 63. Further, the air bag 63 constitutes a hermetically sealed space. The resilient membrane 61 is made of EPDM (ethylene propylene diene monomer), polyurethane rubber, silicone rubber, or the like, and should preferably be resistant to corrosion. The air bag 63 and the L-shaped arm 60 should preferably be provided in a plurality of sets spaced at angularly equally spaced intervals along a certain circumferential pattern on the dresser plate 32. In the present embodiment, the air bag 63 and the L-shaped arm 60 are provided in three sets at angularly equally spaced intervals of 120°. The L-shaped arm 60 may be of an annular shape. The pressure plate 62 is not fixed to the upper surface of the dresser body 31, but is held in slidable engagement therewith.

A fluid passage 55 is connected to the air bag 63 and extends through a through-hole (not shown) formed in the dresser drive shaft 23, and is connected to a pressurized fluid source and/or a vacuum source via a rotary joint, a regulator, a directional control valve, etc. The pressure in the air bag 63 can be adjusted to any desired pressure ranging from a positive pressure to a negative pressure. When a pressurized fluid such as compressed air is supplied through the fluid passage 55 to the air bag 63, the air bag 63 is inflated, thus applying upward forces to the dresser plate 32. The pressure of the pressurized fluid can be regulated by the regulator to control the dressing load based on a balance between the pressure of the pressurized fluid and the weight of the movable assembly of the dresser head 21.

Specifically, the movable assembly of the dresser head 21, which includes the dresser plate 32, the dressing member 22, the torque transmitting pins 41, the cover 49, the L-shaped member 60, the spherical bearing 34, and the linear bearing 36, has a total weight of about 12 kg. The dressing load can be controlled in a range of from about 0 N to about 120 N by a balance between the weight of the movable assembly of the dresser head 21 and the positive pressure in the air bags 63. Because positive pressures can generally be controlled in a wider range and with greater ease than negative pressures, it is preferable to equalize the weight of the movable assembly of the dresser head 21 and a maximum dressing load that is required, and control the dressing load based on the positive pressure in the air bags 63.

Figure 7B:
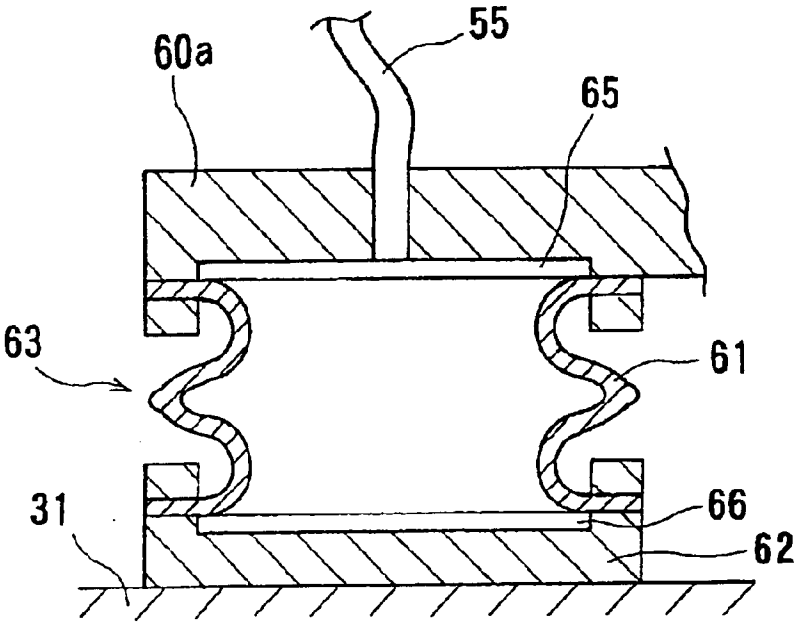
FIG. 7B is a cross-sectional view of the air bag shown in FIGS. 5 and 6, the view showing the state in which the air bag is deflated, i.e., no pressure is applied to the air bag.
Figure 7A:
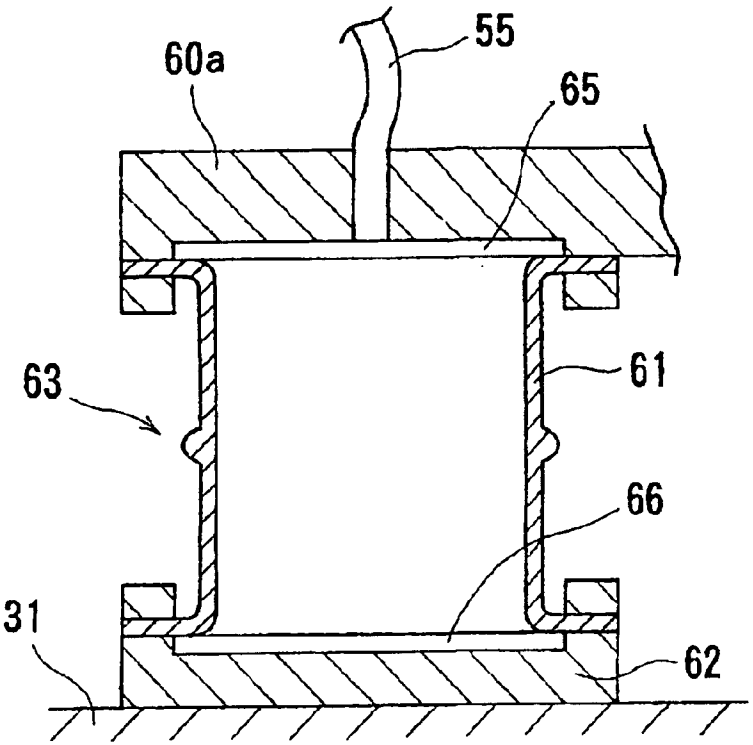
FIG. 7A is a cross-sectional view of an air bag shown in FIGS. 5 and 6, the view showing the state in which the air bag is inflated.

FIGS. 7A and 7B show the manner in which the air bag 63 shown in FIGS. 5 and 6 operate. FIG. 7A shows the state in which the air bag 63 is inflated, and FIG. 7B shows the state in which the air bag 63 is deflated, i.e., no pressure is applied to the air bag 63. In FIG. 7A, the pressurized fluid is introduced into the air bag 63 to inflate the air bag 63, thus expanding the resilient membrane 61 to cause the pressure plate 62 to press the dresser body 31. Thus, an upward force is applied to the dresser plate 32. As a result, the dressing load applied to press the polishing surface 1*a* by the movable assembly of the dresser head 21 is reduced. In FIG. 7B, no pressure is applied to the air bag 63 to deflate the air bag 63, thus contracting the resilient membrane 61. Therefore, the pressure plate 62 does not press the dresser body 31, and no upward force is applied to the dresser plate 32.

In order to accurately control the upward force applied to the dresser plate 32 with the pressure supplied to the air bag 63, recesses 65 and 66 may be formed respectively in a lower surface of the projection 60*a* of the L-shaped arm 60 and an upper surface of the pressure plate 62 for keeping the areas of upper and lower surfaces in the air bag 63 constant even when the resilient membrane 61 is somewhat flexed.

Operation of the dressing apparatus 20 constructed as shown in FIGS. 5 and 6 will be described below.

An air cylinder (not shown) housed in the dresser arm 24 (see FIG. 1) is actuated to lower the dresser drive shaft 23 together with the dresser head 21 from the position shown in FIG. 5. At this time, the stoppers 41*a* are held in engagement with the upper surface of the dresser body 31. The dresser drive shaft 23 is lowered by a predetermined distance to bring the dressing member 22 into contact with the polishing surface 1*a* of the polishing table 5. After the dressing member 22 contacts the polishing surface 1*a* of the polishing table 5, only the dresser shaft 23 and the dresser body 31 are lowered, with the result that the stoppers 41*a* are disengaged from the dresser body 31. Further, the centering shaft 35 slides in the linear bearing 36, and the dressing apparatus 20 comes to the state shown in FIG. 6. Because the dresser drive shaft 23 is lowered until any flexing of the resilient membrane 61 is removed, the areas of the upper and lower surfaces in the air bag 63 are kept constant by the recesses 65 and 66, regardless of slight wear of the polishing surface 1*a* when the polishing surface 1*a* is dressed.

With the state as shown in FIG. 6, the dresser drive shaft 23 is rotated about its own axis, and the dressing member 22 is brought in sliding contact with the polishing surface 1*a*, thereby dressing the polishing surface 1*a*. At this time, the dressing load applied to the polishing surface 1*a* by the dressing member 22 is imposed only by the dresser plate 32 and the parts fixed to the dresser plate 32, and hence such dressing load is relatively small. Specifically, in the embodiment shown in FIGS. 5 and 6, the dressing load is imposed by the dresser plate 32, the dressing member 22, the torque transmitting pins 41, the spherical bearing 34, the linear bearing 36, the L-shaped member 60, and the cover 49, i.e., the weight of the movable assembly of the dresser head 21, and hence such dressing load is small. Since the dressing load is small, an amount of material removed from the polishing surface 1*a* when the polishing surface 1*a* is dressed can be minimized.

If it is necessary to further reduce the dressing load, then the air bags 63 are connected to the pressurized fluid source and the fluid pressure in the air bags 63 is regulated by the regulator to provide a balance between the weight of the movable assembly of the dresser head 21 and the fluid pressure in the air bags 63 for thereby achieving a desired light dressing load.

If the above process is carried out in order to apply a dressing load smaller than the weight of the movable assembly of the dresser head 21, then a dressing load equal to the weight of the movable assembly of the dresser head 21 is temporarily applied to the polishing surface 1*a* when the dressing member 22 is brought into contact with the polishing surface 1*a*. In order to avoid this drawback, the dressing apparatus 20 should preferably be operated as follows.

With the state as shown in FIG. 5, the air bags 63 are connected to the pressurized fluid source and inflated to bring the dresser plate 32 to its uppermost position. Then, the air cylinder (not shown) housed in the dresser arm 24 (see FIG. 1) is actuated to lower the dresser drive shaft 23 and the dresser head 21 by a predetermined distance. At this time, a slight clearance is present between the lower surface of the dressing member 22 and the polishing surface 1*a*. Thereafter, the fluid pressure in the air bags 63 is adjusted to a certain pressure by the regulator to further lower the dresser plate 32 until the lower surface of the dressing member 22 contacts the polishing surface 1*a*, as shown in FIG. 6. Thus, the dressing load applied to the polishing surface 1*a* is of a desired level. Since the lowering distance of the movable assembly of the dresser head 21 is small, the resilient membrane 61 is almost free from any flexing, and the pressure-bearing areas of the upper and lower surfaces in the air bags 63 are kept constant by the recesses 65 and 66, regardless of slight wear of the polishing surface 1*a* when the polishing surface 1*a* is dressed. The fluid pressure in the air bags 63 before the dresser drive shaft 23 is lowered may be of such a level as to achieve a desired dressing load.

Figure 8:
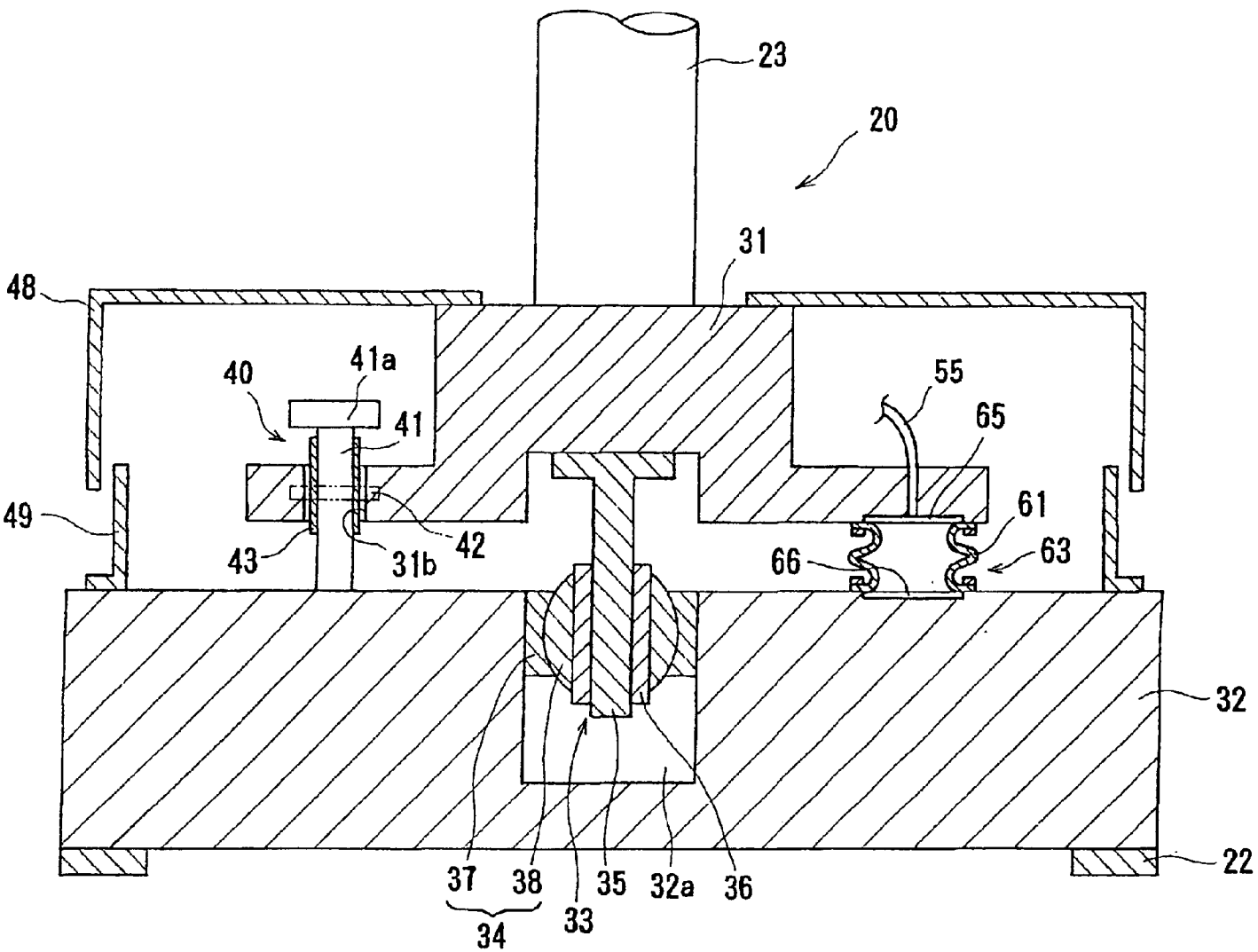
FIG. 8 is a cross-sectional view of a modification of the dressing apparatus according to the third embodiment of the present invention.

FIG. 8 shows in cross section a modification of the dressing apparatus according to the third embodiment of the present invention shown in FIGS. 5 and 6. In the embodiment shown in FIGS. 5 and 6, the air bags 63 are disposed between the upper surface of the dresser body 31 and the L-shaped members 60 fixed to the dresser plate 32. In the embodiment shown in FIG. 8, however, the air bags 63 constituting a hermetically sealed space are disposed between the lower surface of the dresser body 31 and the upper surface of the dresser plate 32. Specifically, the air bags 63 are disposed to connect the lower surface of the dresser body 31 and the upper surface of the dresser plate 32 to each other with the resilient members 61. Operation of the dressing apparatus according to the embodiment shown in FIG. 8 is similar to operation of the dressing apparatus according to the second embodiment shown in FIG. 4. That is, the dressing load is imposed by the dresser plate 32, the dressing member 22, the spherical bearing 34, the linear bearing 36, the torque transmitting pins 41, and the cover 49, i.e., the weight of the movable assembly of the dresser head 21, and hence such dressing load is a light load.

If it is necessary to further reduce the dressing load, then the air bags 63 are connected to the vacuum source, and the negative pressure in the air bags 63 is regulated by the regulator to provide a balance between the weight of the movable assembly of the dresser head 21 and the negative pressure in the air bags 63 for thereby achieving a desired small dressing load. Alternatively, the air bags 63 are connected to the pressurized fluid source and supplied with a pressurized fluid such as compressed air from the pressurized fluid source, and positive pressure in the air bags 63 is regulated by the regulator, thus adding the pressing force imposed by the pressurized fluid to the weight of the movable assembly of the dresser head 21. Therefore, a large dressing load can be applied to the polishing surface 1*a*.

Recesses 65 and 66 formed in upper and lower surfaces in the air bags 63 provide constant pressure-bearing areas in the air bags 63, thus achieving accurate load control.

A dressing process for initializing the polishing pad will be described below.

When the polishing pad or fixed abrasive is replaced with a new one, it is dressed to initialize the polishing surface 1*a*. The amount of material removed from the polishing pad or fixed abrasive by dressing of the polishing surface 1*a* for initialization is much greater than the amount of material removed from the polishing pad or fixed abrasive by dressing of the polishing surface 1*a* during polishing of the workpiece or between polishing of the workpieces. Accordingly, if the dressing load is too small in the initial dressing process, then it is time-consuming to initialize the polishing surface 1*a*, and the serviceability ratio of the polishing apparatus is lowered.

With the dressing apparatus according to the second and third embodiments shown in FIGS. 4 through 8, the dressing load can be changed only by the control of the regulator. Specifically, when the polishing surface 1*a* is initialized, it is dressed under a relatively large dressing load of about 100 N to perform the initializing process at an accelerated rate. After the polishing surface 1*a* is thus quickly initialized, the polishing surface 1*a* is readily available to polish desired workpieces. If the polishing surface 1*a* is dressed at the same time that it polishes the workpiece, then the polishing surface 1*a* is dressed under a small dressing load ranging from 1 N to 5 N. If the polishing surface 1*a* is dressed between polishing cycles, i.e. before or after polishing, then the polishing surface 1*a* is dressed under a small dressing load ranging from 5 N to 20 N. Further, if necessary, the polishing surface 1*a* is dressed under a dressing load ranging from 0 N to 100 N or a higher dressing load.

According to the present invention, as described above, since the dressing load to be applied to dress the polishing surface of the polishing table can be reduced, the amount of material removed from the polishing surface when it is dressed can be minimized, and the service life of the polishing pad or fixed abrasive can be increased. Consequently, the running cost of the polishing apparatus can be lowered.

The present invention relates to a dressing apparatus and a polishing apparatus for polishing a workpiece such as a semiconductor wafer to a planar finish, and is preferably utilized in manufacturing semiconductor devices.

What is claimed is:

1. A dressing apparatus for dressing a polishing surface of a polishing table for polishing a surface of a workpiece, the dressing apparatus comprising:

a dresser body connected to a dresser drive shaft which is vertically movable;

a dresser plate which is vertically movable with respect to said dresser body and is tiltable so as to follow the polishing surface;

a dressing member held by said dresser plate for dressing the polishing surface; and a hermetically sealed space defined by said dresser body, said dresser plate and a resilient membrane;

wherein said dresser body and said dresser plate are connected by said resilient membrane.

2. A dressing apparatus according to claim 1, wherein a fluid having a positive pressure or a negative pressure is supplied to said hermetically sealed space, and a dressing load is adjusted by controlling said positive pressure or said negative pressure.

3. A dressing apparatus for dressing a polishing surface of a polishing table for polishing a surface of a workpiece, the dressing apparatus comprising:

a dresser body connected to a dresser drive shaft which is vertically movable;

a dresser plate which is vertically movable with respect to said dresser body and is tiltable so as to follow the polishing surface;

a dressing member held by said dresser plate for dressing the polishing surface; and a hermetically sealed space provided between said dresser body and said dresser plate or a member fixed to said dresser plate;

wherein at least a part of said hermetically sealed space is formed by a resilient membrane.

4. A dressing apparatus according to claim 3, wherein a fluid having a positive pressure or a negative pressure is supplied to said hermetically sealed space to generate an upward force or a downward force applied to said dresser plate.

5. A dressing apparatus according to claim 4, wherein when an upward force applied to said dresser plate is generated, a dressing load is obtained by subtracting said upward force obtained by supplying said positive pressure or said negative pressure to said hermetically sealed space from a weight of said dresser plate including said dressing member.

6. A dressing apparatus according to claim 4, wherein when said dresser plate is vertically moved with respect to said dresser body, pressure-bearing areas of upper and lower surfaces in said hermetically sealed space are not varied.

7. A dressing apparatus according to claim 4, wherein when said dresser plate is vertically moved with respect to said dresser body, pressure-bearing areas of upper and lower surfaces in said hermetically sealed space are not varied.

8. A dressing apparatus for dressing a polishing surface of a polishing table for polishing a surface of a workpiece, the dressing apparatus comprising:

a dresser body connected to a dresser drive shaft which is vertically movable;

a dresser plate which is vertically movable with respect to said dresser body and is tiltable so as to follow the polishing surface;

a dressing member held by said dresser plate for dressing the polishing surface;

a gimbal mechanism provided between said dresser body and said dresser plate such that said dresser plate is tiltable so as to follow an inclination of said polishing surface and is vertically movable with respect to said dresser body; and a hermetically sealed space defined by said dresser body, said dresser plate and a resilient membrane;

wherein said dresser body and said dresser plate are connected by said resilient membrane.

9. A dressing apparatus according to claim 8, wherein a fluid having a positive pressure or a negative pressure is supplied to said hermetically sealed space, and a dressing load is adjusted by controlling said positive pressure or said negative pressure.

10. A dressing apparatus for dressing a polishing surface of a polishing table for polishing a surface of a workpiece, the dressing apparatus comprising:

a dresser body connected to a dresser drive shaft which is vertically movable;

a dresser plate which is vertically movable with respect to said dresser body and is tiltable so as to follow the polishing surface;

a dressing member held by said dresser plate for dressing the polishing surface;

a gimbal mechanism provided between said dresser body and said dresser plate such that said dresser plate is tiltable so as to follow an inclination of said polishing surface and is vertically movable with respect to said dresser body; and a hermetically sealed space provided between said dresser body and said dresser plate or a member fixed to said dresser plate;

wherein at least a part of said hermetically sealed space is formed by a resilient membrane.

11. A dressing apparatus according to claim 10, wherein a fluid having a positive pressure or a negative pressure is supplied to said hermetically sealed space to generate an upward force or a downward force applied to said dresser plate.

12. A dressing apparatus according to claim 11, wherein when an upward force applied to said dresser plate is generated, a dressing load is obtained by subtracting said upward force obtained by supplying said positive pressure or said negative pressure to said hermetically sealed space from a weight of said dresser plate including said dressing member.

13. A dressing apparatus according to claim 12, wherein when said dresser plate is vertically moved with respect to said dresser body, pressure-bearing areas of upper and lower surfaces in said hermetically sealed space are not varied.

14. A dressing apparatus according to claim 11, wherein when said dresser plate is vertically moved with respect to said dresser body, pressure-bearing areas of upper and lower surfaces in said hermetically sealed space are not varied.

* * * * *

UNITED STATES PATENT AND TRADEMARK OFFICE

CERTIFICATE OF CORRECTION

PATENT NO. : 6,899,604 B2
DATED : May 31, 2005
INVENTOR(S) : Tetsuji Togawa et al.

It is certified that error appears in the above-identified patent and that said Letters Patent is hereby corrected as shown below:

Column 14,
Line 1, change “4” to -- 5 --.

Signed and Sealed this

Fourth Day of October, 2005

JON W. DUDAS
*Director of the United States Patent and Trademark Office*